US007159891B1

(12) United States Patent
Niggemann

(10) Patent No.: US 7,159,891 B1
(45) Date of Patent: Jan. 9, 2007

(54) ALL-TERRAIN SKI

(76) Inventor: Dale Niggemann, 120 Shorewood Ter., Wisconsin Rapids, WI (US) 54494

( * ) Notice: Subject to any disclaimer, the term of this patent is extended or adjusted under 35 U.S.C. 154(b) by 226 days.

(21) Appl. No.: 10/860,845

(22) Filed: Jun. 4, 2004

Related U.S. Application Data

(60) Provisional application No. 60/525,820, filed on Nov. 26, 2003.

(51) Int. Cl.
*A63C 9/18* (2006.01)

(52) U.S. Cl. ..... 280/607; 280/613; 280/614; 280/625; 280/615; 280/618; 280/617; 280/636; 482/70

(58) Field of Classification Search ..... 280/607, 280/625–636, 613–618; 484/70
See application file for complete search history.

(56) References Cited

U.S. PATENT DOCUMENTS 1,982,843 A * 12/1934 Traver ..... 482/70
4,002,354 A * 1/1977 Ramer ..... 280/614
4,033,596 A * 7/1977 Andorsen et al. ..... 280/842
4,102,541 A * 7/1978 Altorfer et al. ..... 280/842
4,273,355 A * 6/1981 Storandt ..... 280/614
4,363,492 A * 12/1982 Eriksson ..... 280/842
4,645,201 A * 2/1987 Evans ..... 482/70
4,709,918 A * 12/1987 Grinblat ..... 482/70
4,836,567 A * 6/1989 Schmid ..... 280/842
4,867,443 A 9/1989 Jensen
4,898,403 A 2/1990 Johnson
5,072,929 A 12/1991 Peterson et al.
5,246,412 A * 9/1993 Chen ..... 482/70
6,017,050 A * 1/2000 Girard ..... 280/615
6,082,768 A 7/2000 Johnson
6,254,113 B1 7/2001 Dornan
6,435,537 B1 * 8/2002 Veux ..... 280/615

* cited by examiner

*Primary Examiner*—J. Allen Shriver
*Assistant Examiner*—Cynthia F. Collado
(74) *Attorney, Agent, or Firm*—John E. Cepican

(57) ABSTRACT

An all-terrain ski upon which various cross-country skiing techniques can be used by having a sliding member (2) slide over a base member (1) to simulate gliding on snow. The sliding member is held down by medium washers (6) and uses wheel and bearing assemblies (5) to glide. There is a return mechanism (3) that is connected to sliding member (2) and base member (1) which provides resistance and returns the sliding member (2) and base member (1) to their original position before the sliding member was slid.

44 Claims, 12 Drawing Sheets

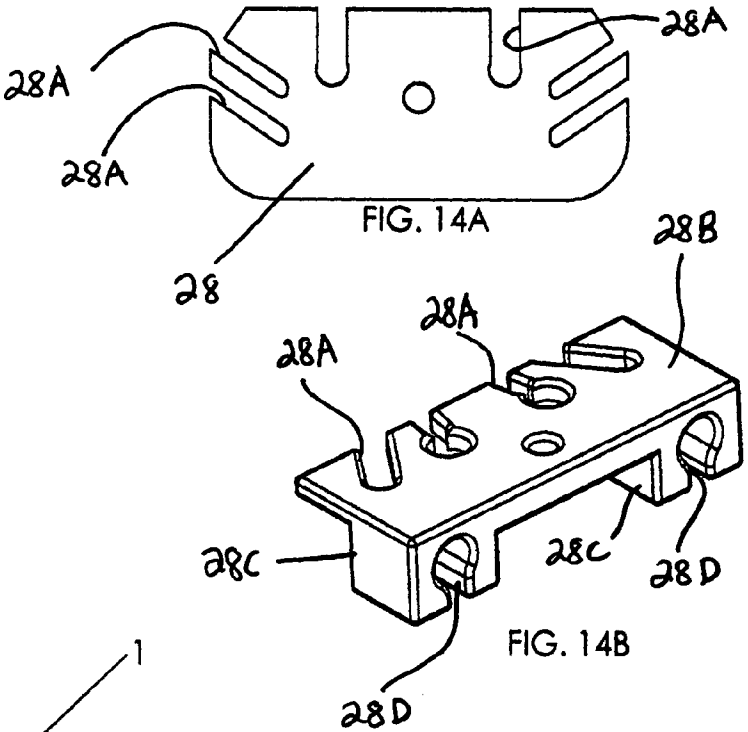
FIG. 14A
FIG. 14B
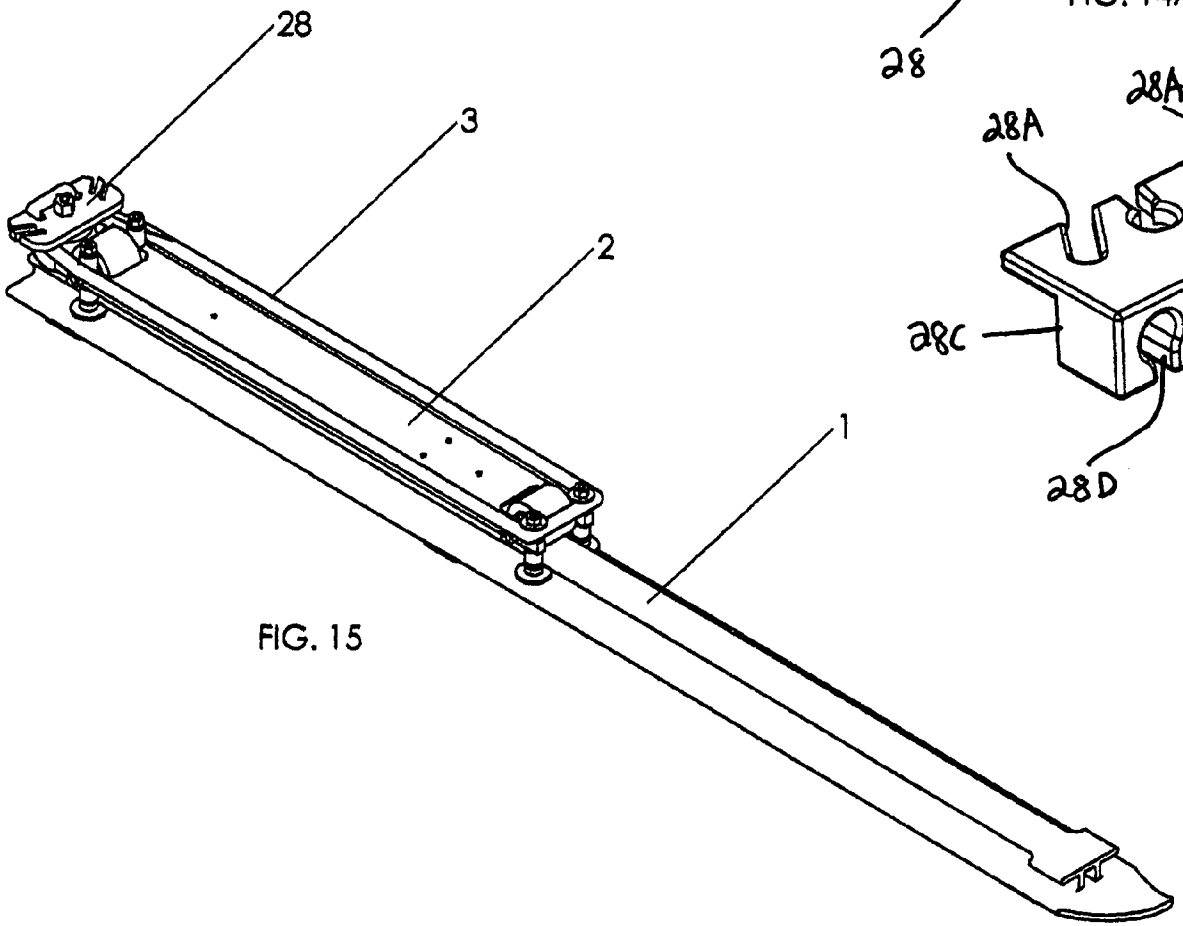
FIG. 15

ALL-TERRAIN SKI

CROSS-REFERENCE TO RELATED APPLICATIONS

This application is a continuation of co-pending commonly owned U.S. Provisional Application No. 60/525,820, filed Nov. 26, 2003, entitled All-Terrain Ski. Priority is claimed under 35 U.S.C. §119(e). The contents of the same are expressly incorporated herein by reference.

STATEMENT REGARDING FEDERALLY SPONSORED RESEARCH OR DEVELOPMENT

Not applicable.

REFERENCE TO SEQUENCE LISTING

Not applicable.

AUTHORIZATION PURSUANT TO 37 C.F.R. § 1.71(d)(e)

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to cross-country skiing. More specifically, this invention relates to cross country ski training with a mechanism.

2. Description of Related Art

Cross-country skiers use many different devices to simulate snow when out of season. Three of the most popular devices are roller skis, off-road roller skis, and cross-country exercise machines.

Roller skis usually have one or two wheels mounted at the ends of a narrow member as seen in FIG. 18, U.S. Pat. No. 4,033,596 to Andorson et al., 1977 Jul. 5. They are typically used by more competitive skiers and simulate snow skiing by rolling atop flat outdoor surfaces such as paved roads.

Roller skis are generally very unstable compared to similar devices such as inline skates or roller skates and are dangerous at high speeds. This alone dissuades many recreational skiers and competitive skiers alike from using them. For workouts, they usually can only offer as much resistance as the bearings in the wheels offer and can be difficult and time consuming to replace when a different resistance is wanted. They usually also have soft wheels to absorb road vibration and to control speed which wear out quickly and can be expensive to replace. As the wheels are typically small, they require well-maintained roads which can be hard to locate. When good roads are used, users still have to be careful to avoid any road hazards, such as cracks, pot holes, and loose gravel that catch the small wheels. Most roller skis do not have any means for braking and those that do only reduce speed. That means that when skiing along roads, users have very little control on hills and through intersections. Finally, the most dangerous and negative aspect is that by skiing on roads, roller skiers must be cautious of automobiles while having very little control over their own movements.

Off-road roller skis are similar to conventional roller skis in that they have generally one or two wheels mounted on at the ends of a narrow elongated member. An example of this is U.S. Pat. No. 6,254,113 to Dornan, 2001 Jul. 3, seen in FIG. 19. Although they are minimally used by cross-country skiers, they are generally used by a broader range of skiers than normal roller skis because they do not have to share paths with automobiles and may be used on more surfaces. The wheels on off-road roller skis are generally much larger than normal roller ski wheels and are often pneumatic. This leads to many problems, the first of such being flat tires and wheel blowouts which can strand users during a workout. Furthermore, in an effort to reduce weight, thinner tires are used and therefore are less resistant to wear than a typical solid roller ski wheel. Off-road roller skis are also still limited to fairly smooth paths such as crushed limestone and work poorly on terrains such as sand, gravel or grass. Furthermore, these roller skis are much heavier and therefore harder to control. The greatest problem is that the off-road ski is less stable than customary roller skis because of higher ground clearance and higher center of gravity. Ultimately, this can teach and cause reinforcement of poor and improper skiing technique.

Cross-country exercise machines are used by less experienced skiers and recreational skiers. An illustration of a typical machine is FIG. 20, from U.S. Pat. No. 5,246,412 to Chen, 1993 Sep. 21. They are made to be used indoors and take up a good amount of space. They are also heavy and bulky, requiring many parts and significant frames to support users' weight. All this makes them expensive and limits the number of people who are able to purchase them. They also do not provide an especially accurate simulation of ski technique and can deteriorate a skier's technique. And, they are traditionally limited to a single technique, the diagonal stride. Additionally, they have also been found to cause unnecessary back stress from users leaning forward while pushing and pulling hand levers.

BRIEF SUMMARY OF THE INVENTION

This device is an all-terrain ski that uses a member sliding over a base member to simulate cross-country skiing techniques. The sliding member is held down by medium washers and uses wheel and bearing assemblies to glide. There is a return mechanism that is connected to sliding member and base member which provides resistance and returns the sliding member and base member to their original position before the sliding member was slid.

Accordingly, several objects and advantages of my invention are:

(a) can be used and adapted to by any skier of any ability level;
(b) very easy to control and requires less balance;
(c) road vibration is not an issue;
(d) stops easily and without the assist of a braking mechanism;
(e) maintains a safe and relatively low speed at all times;
(f) may be used on virtually any surface;
(g) low center of gravity aids stability;
(h) very small and light compared to exercise machines;
(i) priced comparably to roller skis and less than exercise machines;
(j) simulates proper skiing technique;
(k) not limited to any single technique;

(l) provides users with an excellent cardiovascular and strength workout;

(m) may be used indoors and outdoors;

(n) may be used on a very wide variety of terrains including grass, gravel, sand, roads, and dirt trails;

(o) adjustable levels of resistance for varying difficulty of workouts;

(p) adjustable ratchet bearings provide different types of workouts.

Further objects and advantages of my invention will become apparent from a consideration of the drawings and ensuing description.

BRIEF DESCRIPTION OF THE SEVERAL VIEWS OF THE DRAWINGS

FIG. 14A is a top view of a bunji holder;

FIG. 14B is an isometric view of an alternative bunji holder;

FIG. 15 is an isometric view of an all-terrain ski with the bunji holder;

Figures 1, 2:
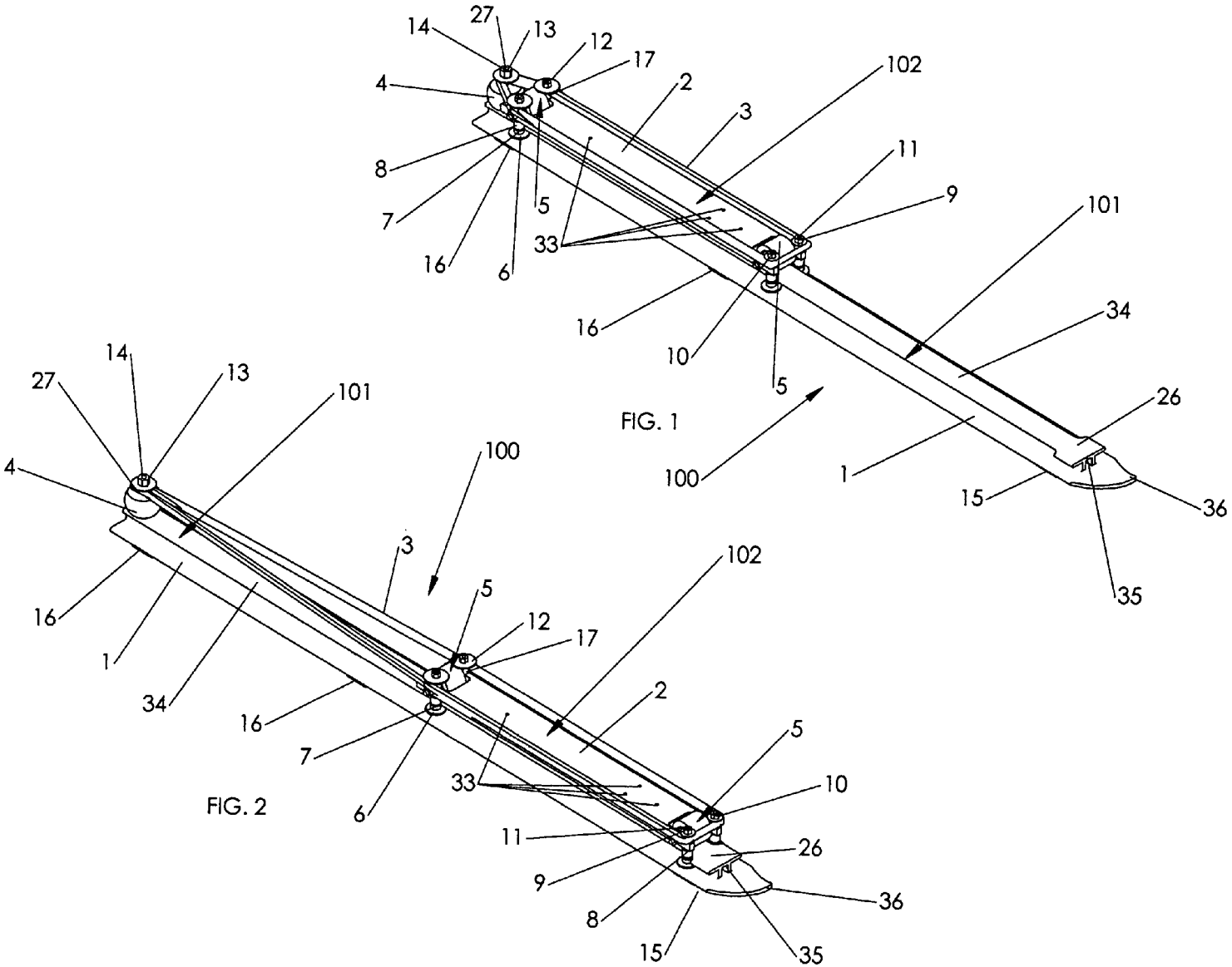
FIG. 1 shows an isometric view of the ski in its starting position.
FIG. 2 shows an isometric view of the ski, the top member having slid across the base member in the end position.

| DRAWINGS - Reference Numerals | |
|---|---|
| 1 | base member |
| 1A | alternate base |
| 1B | solid base member |
| 2 | sliding member |
| 3 | return mechanism |
| 4 | shock absorber |
| 5 | wheel and bearing assembly |
| 6 | medium washer |

-continued

| DRAWINGS - Reference Numerals | |
|---|---|
| 7 | side bearing |
| 8 | spacer |
| 9 | top washer |
| 10 | top nut |
| 11 | screw |
| 12 | large washer |
| 13 | large nut |
| 14 | rear screw |
| 15 | front pad |
| 16 | rear pad |
| 17 | top spacer |
| 18 | wheel nut |
| 19A | wheel spacer |
| 19B | wheel spacer |
| 20A | wheel bearing |
| 20B | wheel bearing |
| 21 | outer ratchet bearing |
| 22 | cassette |
| 23 | tire |
| 24 | inner ratchet bearing |
| 25 | wheel bolt |
| 26 | end flare |
| 27 | rear point |
| 28 | bunji holder |
| 29 | rolling base |
| 30 | rolling tip |
| 31 | flexible connector |
| 32 | connector bracket |
| 33 | mounting hole |
| 34 | top surface |
| 35 | front end |
| 36 | tip |
| 37 | binding |
| 38 | boot |
| 39 | flexible plate |
| 40 | foot straps |
| 100 | ski assembly |
| 101 | stationary assembly |
| 102 | moving assembly |
| 103 | additional assembly |

DETAILED DESCRIPTION OF THE INVENTION

FIGS. 1–5, 7 Preferred Embodiment

Figure 3:
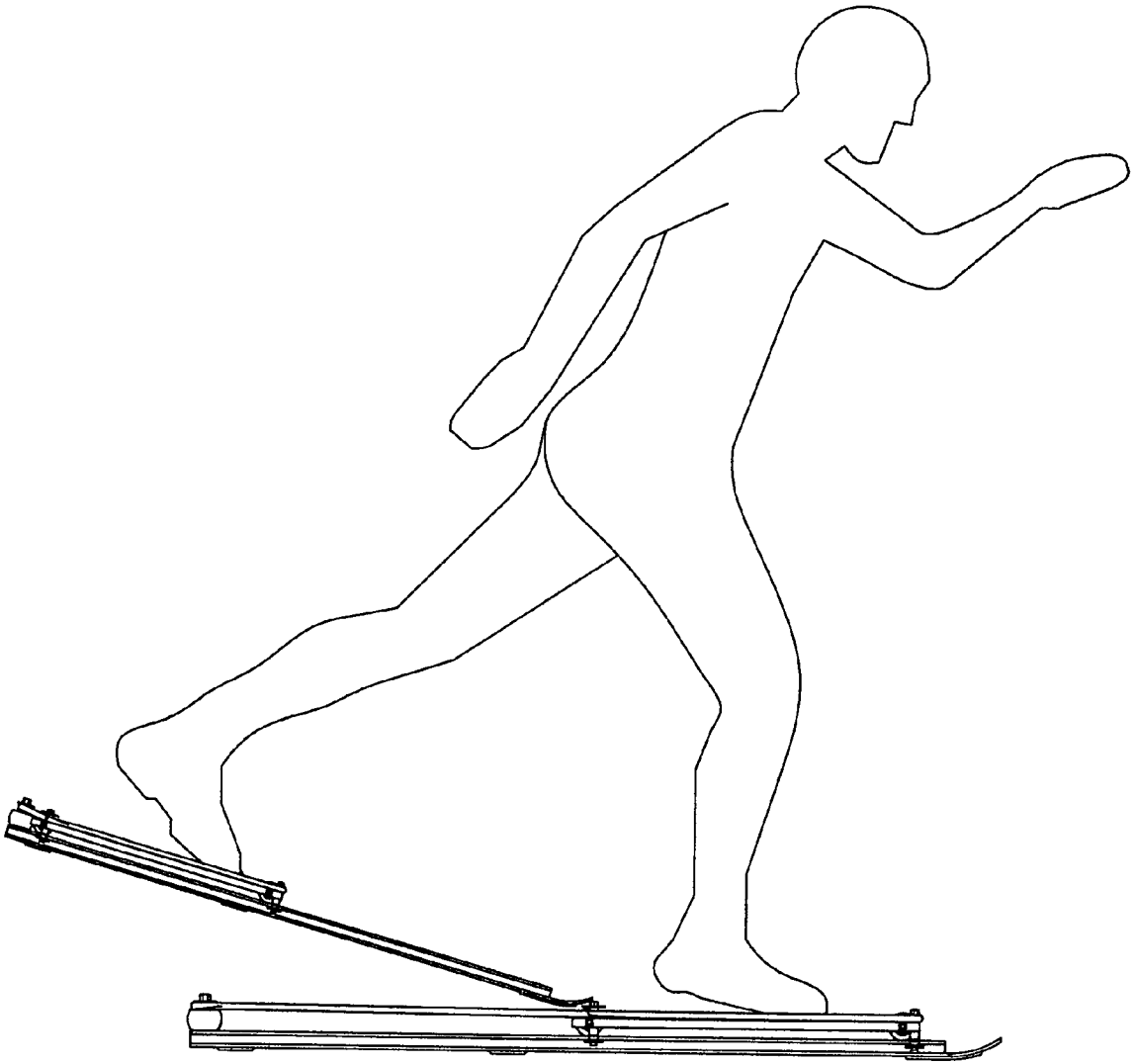
FIG. 3 is a reduced side view showing the body position of a user of the all-terrain ski of FIG. 1 and FIG. 2.
Figure 4:
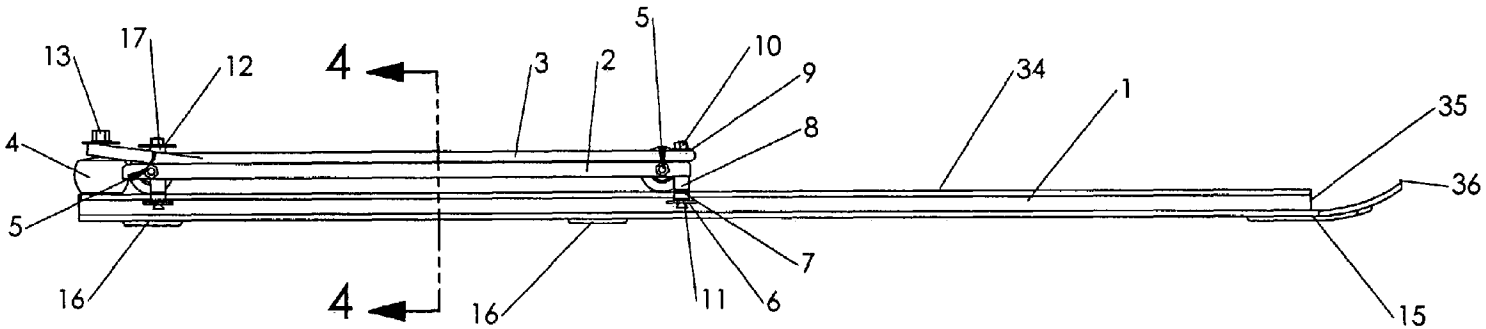
FIG. 4 is an enlarged side view of the ski in the starting position of FIG. 1.

A preferred embodiment of the all-terrain ski is illustrated similarly in FIGS. 1–5 and 7. The all-terrain ski begins with a sliding member 2 on a top surface 34 which is the top of base member 1. Base member 1 is hollow and has a tip 36 angled up. On the bottom of said base member 1 there are three pads which are best seen in FIG. 4. There is one front pad 15 at the front of base member 1 and two rear pads 16 which are at the center and rear. Sliding member 2 is supported by two wheel and bearing assemblies 5 which are at opposite ends of the member. Sliding member 2 is held down to base member 1 by medium washer 6 that is held on by a screw 11. Additionally, screw 11 holds two spacers and a bearing; a top spacer 17 on the top of sliding member 2, a spacer 8 on the bottom of sliding member 2, and a side bearing 7 which is above a medium washer 6 and rolls along the top edge of base member 1 horizontally.

Around four screws 11 of sliding member 2 and a rear screw 14 of base member 1 is a return mechanism 3 an elastomeric member such as a bungee cord. Return mechanism 3 is prevented from slipping off of sliding member 2 by two top washers 9 on the front of the sliding member 2 and two large washers 12 on the rear of sliding member 2. Return mechanism 3 is prevented from slipping off of rear screw 14 by a third large washer 12. Return mechanism 3 is held between large washer 12 and a shock absorber 4. Shock absorber 4 is a spherical elastomer having a hole in it through which rear screw 14 passes and holds spherical elastomer in place on top of the rear of base member 1. A large nut 13 is threaded onto the top of rear screw 14 and that keeps shock absorber 4, return mechanism 3, and large washer 12 in place.

Figure 10:
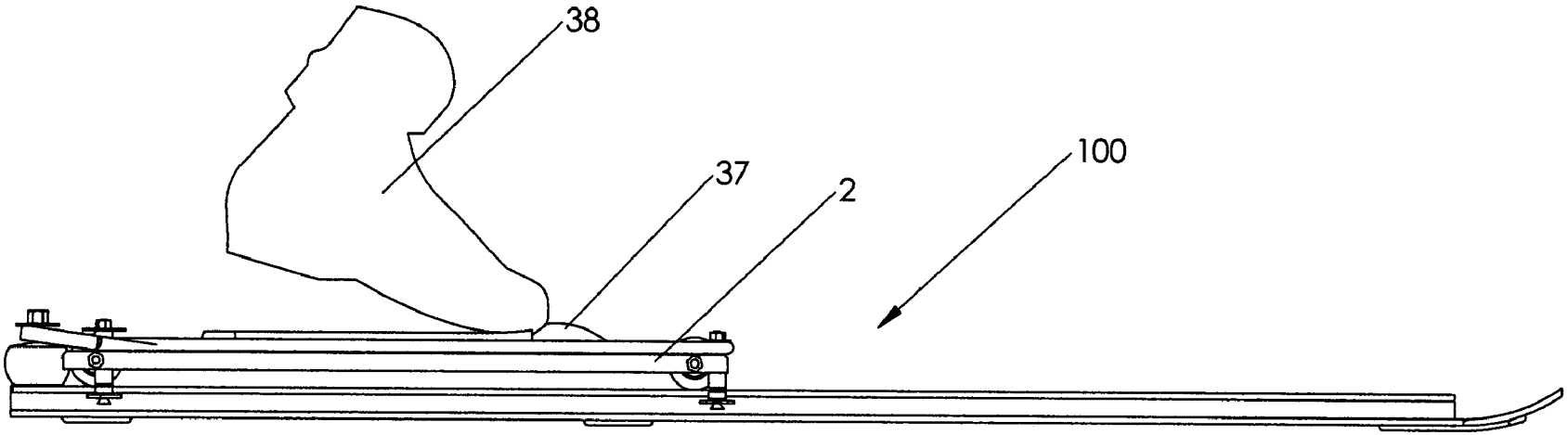
FIG. 10 is a side view of an all-terrain ski with a cross-country ski binding and boot.

Additionally, there are four mounting holes 33 on the top of sliding member 2. Said mounting holes serve as means for mounting a cross-country ski binding similar to a binding 37 as seen in FIG. 10.

Wheel and bearing assembly 5 is comprised of both bearings and fasteners and allows the wheel to turn while holding its center in place. This specific bearing is ratcheted and therefore allows the assembly to turn in only one direction. All pieces of the wheel and bearing assembly are connected by and concentric about a wheel bolt 25. Wheel bolt 25 goes through horizontal holes in the walls of sliding member 2 with the head of wheel bolt 25 pressed against the outer wall of sliding member 2. Starting from the end of wheel bolt 25, a wheel nut 18 is the first part. It is threaded onto wheel bolt 25 and tightened up to the side of sliding member 2. On the inside of sliding member 2 is a wheel spacer 19A. Wheel spacer 19A is held between the inner wall of sliding member 2 and a wheel bearing 20A with the chamfered edge 19C toward a tire 23. Wheel bearing 20A is press fitted inside a cassette 22 which is also press fitted inside tire 23 so it cannot rotate relative to tire 23. Wheel bearing 20A is also in contact with an inner ratchet bearing 24 which is inside of an outer ratchet bearing 21. Outer ratchet bearing 21 is inside and in the middle of cassette 22. Outer ratchet bearing 21 also has small cylinders upon which an inner ratchet bearing 24 rotates and allowing wheel and bearing assembly 5 to only rotate in the forward direction along base member 1 when engaged. On the other side of cassette 22 is another bearing, wheel bearing 20B which is similarly in contact with cassette bearing 24 and is held against the opposing inner wall of cassette 22. A wheel bearing 20B is also sandwiched between wheel spacer 19B with chamfered edge 19D and the opposing inner wall of sliding member 2.

Figure 6:
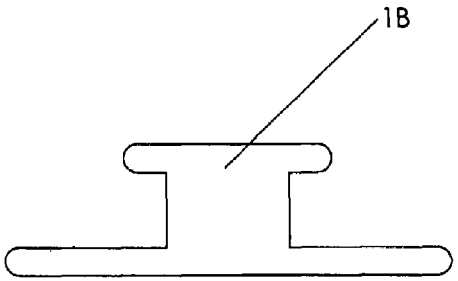
FIG. 6 is an enlarged front view of a solid base member.
Figure 5:
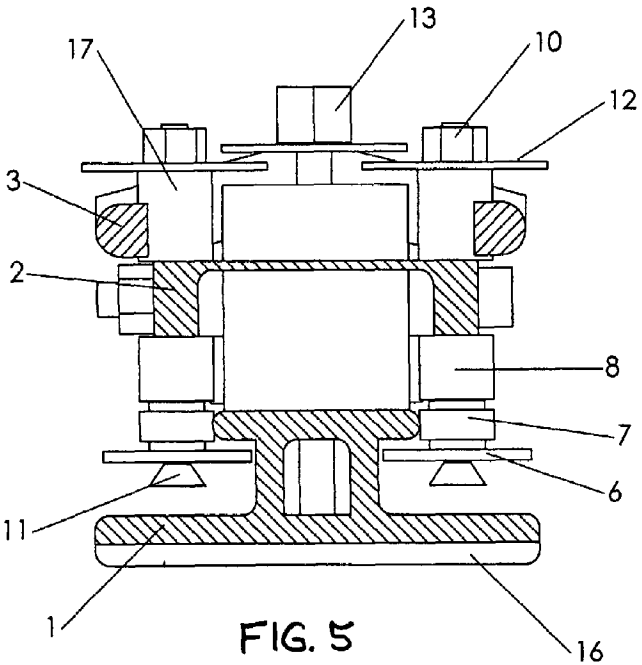
FIG. 5 is an enlarged cross-section of the ski taken from FIG. 4 along line 4—4.
Figure 7:
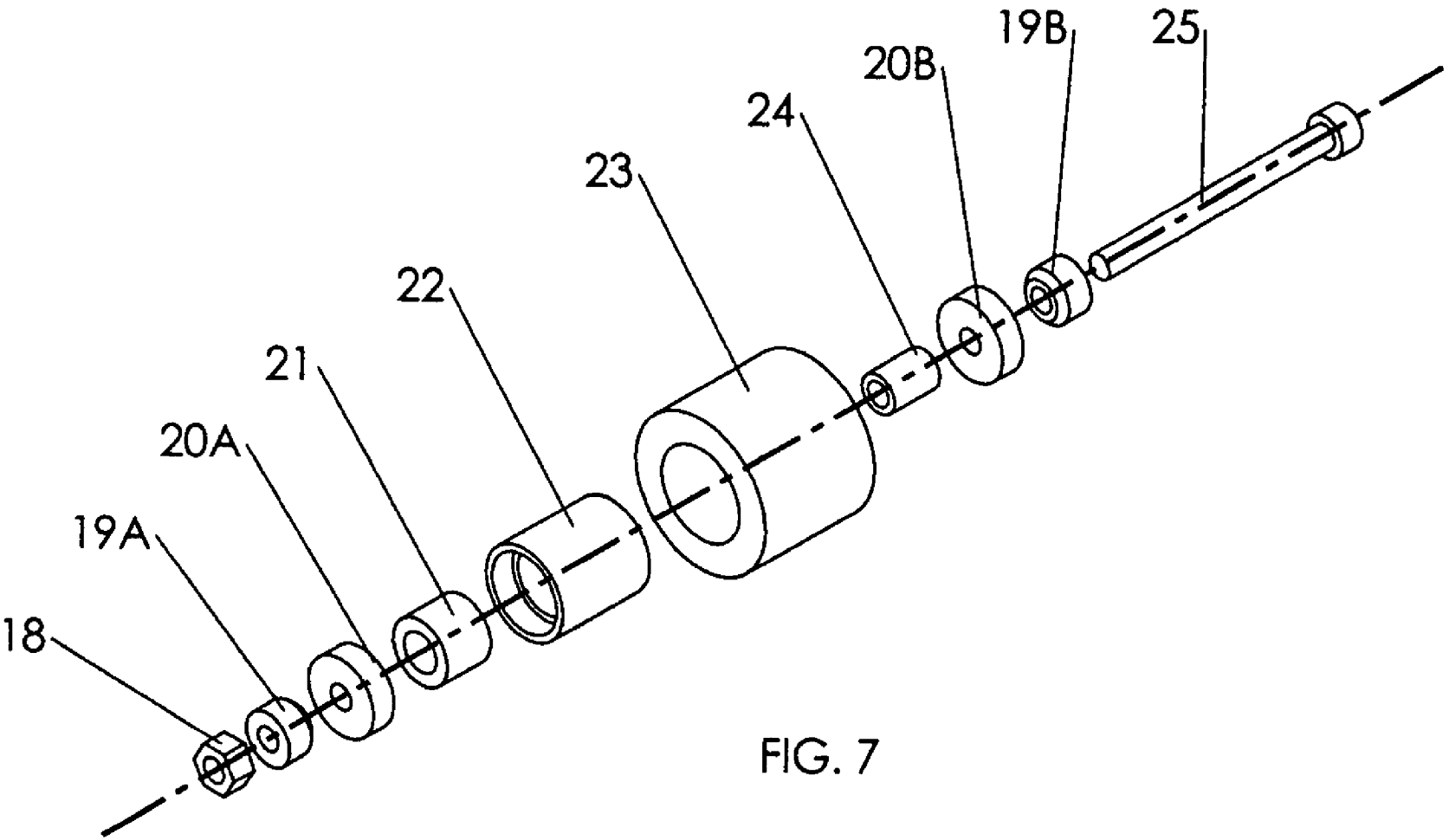
FIG. 7 is an exploded view of the wheel and bearing assembly.

FIG. 6—Alternative Embodiment

This shows a solid base member 1B similar to base member 1. It is of similar shape and would be made of the same material. Said solid base member 1B simply serves as an alternate base to be used in ski assembly 100.

Figure 8:
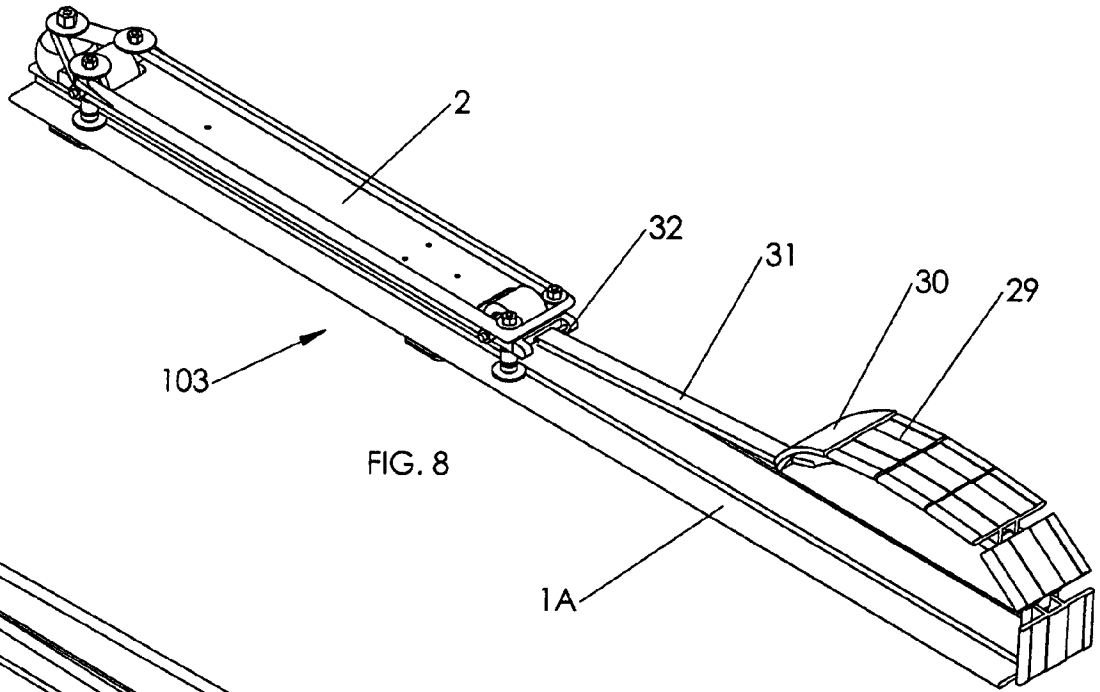
FIG. 8 is an isometric view of an alternate embodiment.
Figure 9:
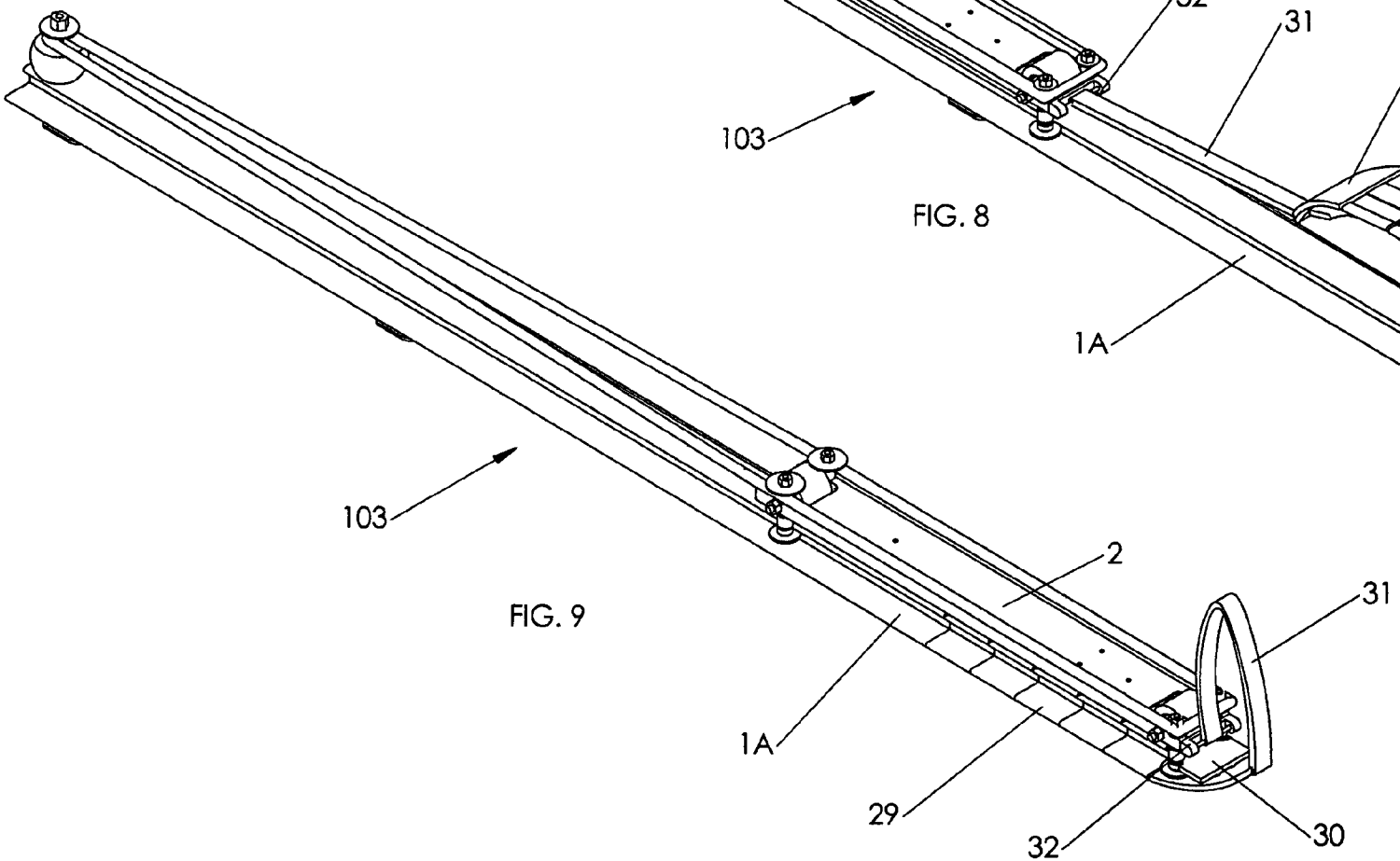
FIG. 9 is an isometric view of the embodiment of FIG. 8, the top member having slid across the base member in the end position.

FIGS. 8, 9—Alternative Embodiment

This embodiment is similar to the preferred embodiment with slight differences in parts. Instead of using base member 1 for the base of the ski, an alternate base 1A is used. Alternate base member 1A is connected to a chain of rolling bases 29. The other end of the chain is connected to a rolling tip 30. Rolling bases 29, alternate base member 1A, and rolling tip 30 are all connected by interlocking pivot points that allow them to roll forward and back. Rolling tip 30 is also attached to a flexible connector 31. Flexible connector 31 is then attached to a connector bracket 32 which is affixed to sliding member 2.

Figure 11:
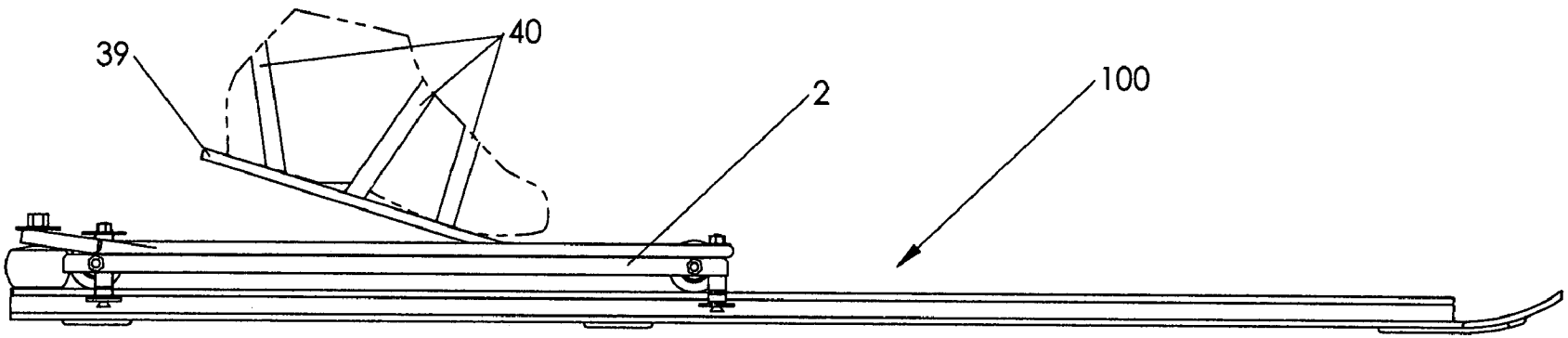
FIG. 11 is a side view of an all-terrain ski with a flexible plate and foot straps.

FIG. 11—Alternative Embodiment

FIG. 10 shows ski assembly 100 with traditional binding 37 and boot 38. The binding attaches to sliding member 2 with mounting holes 33.

FIG. 11 has a flexible plate 39 and foot straps 40 in place of said binding 37 and said boot 38. It likewise attaches to sliding member 2.

Both binding 37 with boot 38 and flexible plate 39 with foot straps 40 serve the purpose of attaching a user's foot to the all-terrain ski to enable performance of classical or traditional technique shown in FIG. 3.

Figure 12:
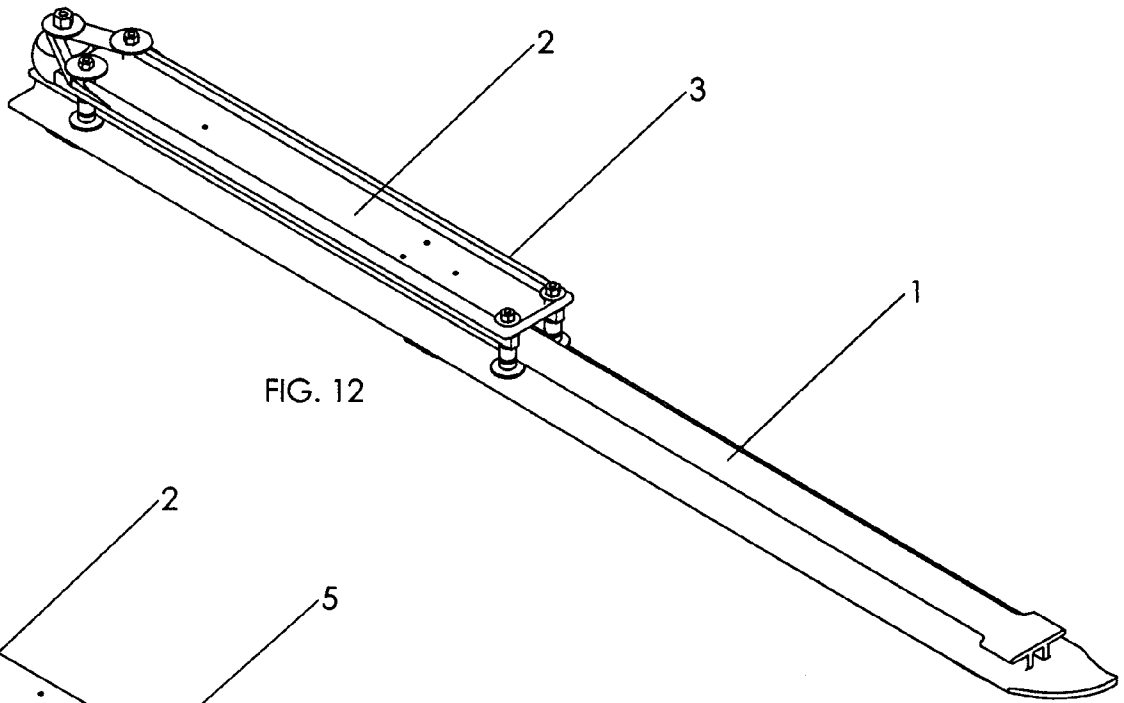
FIG. 12 is an isometric view of a second alternate embodiment, an all-terrain ski without wheels or bearings.
Figure 13:
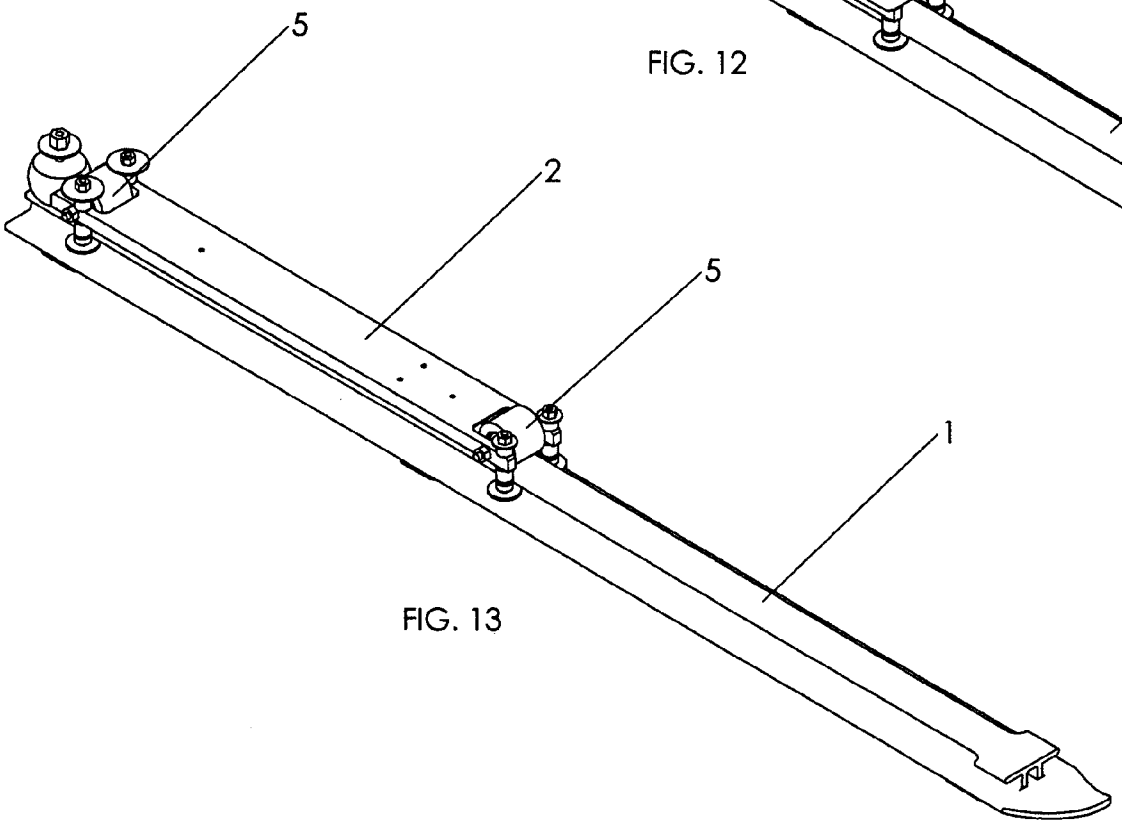
FIG. 13 is an isometric view of an all-terrain ski without a return mechanism.

FIGS. 12, 13—Alternative Embodiment

These are very similar to the preferred embodiment. They differ in that they illustrate the all-terrain ski without certain parts.

In FIG. 12 the all-terrain ski does not have wheel and bearing assemblies 5. Sliding member 2 sits directly on top of base member 1 and slides across said member akin to ski assembly 100.

In FIG. 13 the all-terrain ski does not have return mechanism 3. This illustrates ski assembly 100 when the return mechanism 3 has been removed for replacement or adjustment.

FIGS. 14A, 14B, 15—Alternative Embodiment

This embodiment is also very similar to the preferred embodiment. Here, larger washers 12 in the rear of the ski are removed and replaced with a return holder 28. Return holder 28 does the job of holding return mechanism 3 down and also allows for adjustment.

In this embodiment return mechanism 3 is comprised of an elastomer or bunji which is pulled through the slots 28A of return holder 28. An elastomer or bunji will be able to stretch and therefore allow for a plurality of amounts of return mechanism 3 to be pulled through the slots. By varying the amount of return mechanism 3 that is drawn through return holder 28, the tension of return mechanism 3 is adjusted.

Alternate return holder 28B has slots 28A and also depending members 28C with guide channels 28D for the elastomer or bunji.

Figure 16B:
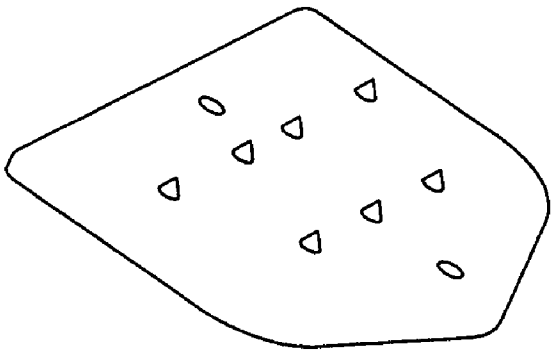
FIG. 16B is an isometric view of an all-terrain ski gripper with studs.
Figure 16A:
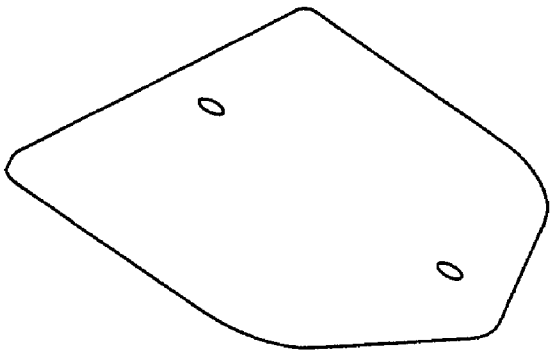
FIG. 16A is an isometric view of an all-terrain ski gripper.

FIGS. 16A, 16B—Alternative Embodiment

FIG. 16A is of rear pad 16. FIG. 16B alternatively shows rear pad 16 with studs made of a hard material.

Figure 17B:
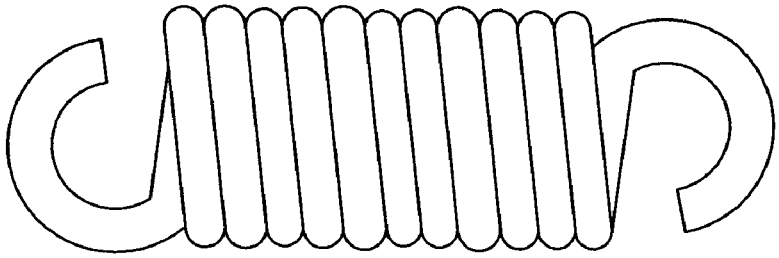
FIG. 17B is a front view of an alternate return mechanism.
Figure 17A:
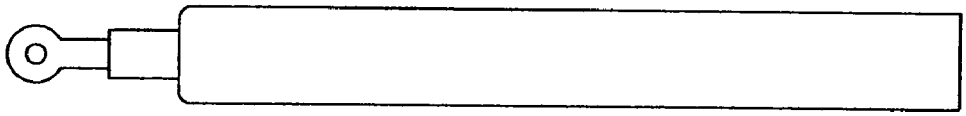
FIG. 17A is a front view of an alternate return mechanism.
Figure 19:
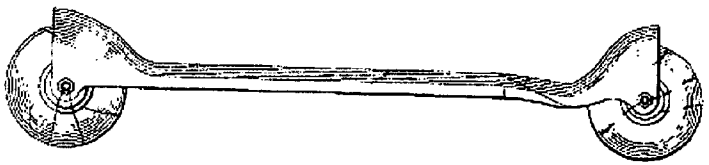
FIG. 19 PRIOR ART
FIG. 19 is a side view of a prior art off-road roller ski.
Figure 18:
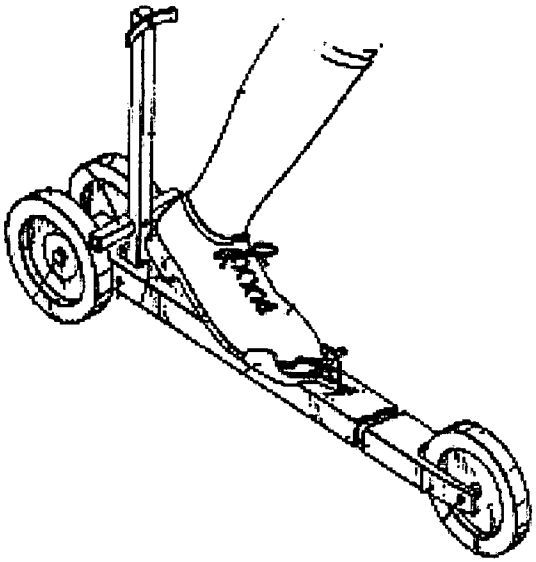
FIG. 18 PRIOR ART
FIG. 18 is a perspective view of a prior art roller ski.
Figure 20:
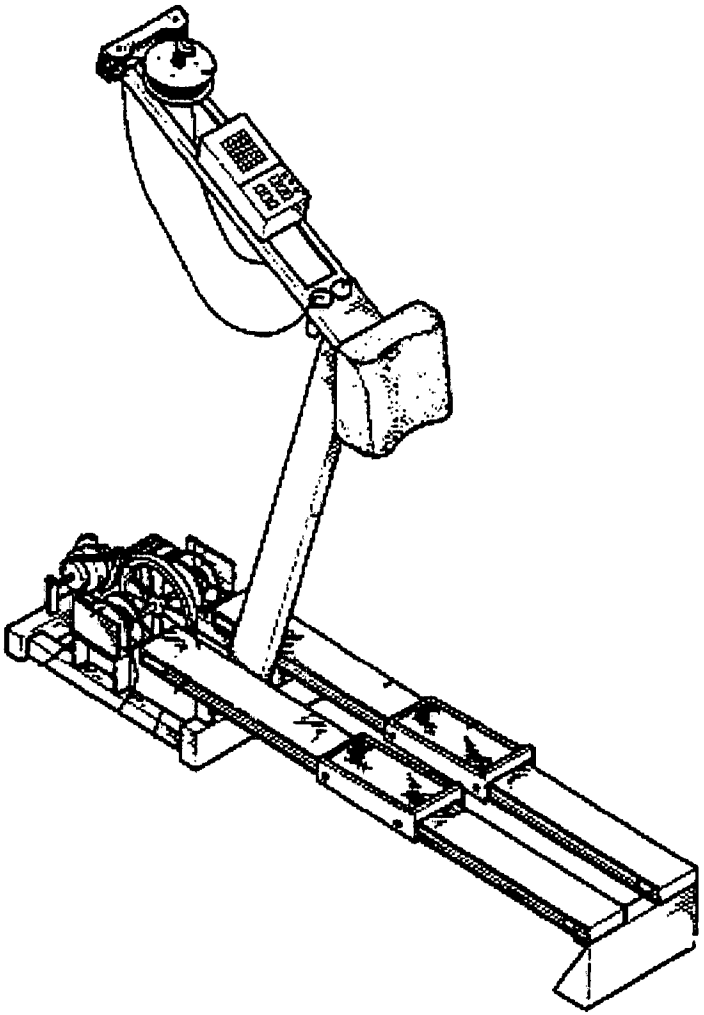
FIG. 20 PRIOR ART
FIG. 20 is an isometric view of a cross-country exercise machine.

FIGS. 17A, 17B—Alternative Embodiment

There are several types of return mechanisms that could be used in ski assembly 1 other than return mechanism 3. Examples of other return mechanisms include gas springs, air springs, torsion springs, extension springs and dampers. FIG. 17A and FIG. 17B show other possible return mechanisms. FIG. 17A is a gas spring and 17B is an extension spring.

Operation—FIGS. 1, 2, 3

Complete ski assembly 100 is seen in its start position in FIG. 1 and in the end position in FIG. 2. A person standing with one foot on sliding member 2 pushes sliding member 2 forward, toward a front end 35, until sliding member 2 is near end flare 26 at the end of base member 1. When ski assembly 100 is in operation, all parts can be divided into either stationary assembly 101 or moving assembly 102 with one exception, return mechanism 3. The only part that changes is that return mechanism 3 has stretched from its initial state in FIG. 1 to an elongated state in FIG. 2.

Largely, parts of stationary assembly 101 connected to base member 1 remain stationary from FIG. 1 to FIG. 2. Front pad 15 and rear pads 16 remain stationary and are used to prevent the movement of base member 1 by increasing the friction between base member 1 and any surface it is used on. Rear screw 14 remains set as it goes through the rear of base member 1 and holds in place shock absorber 4, large washer 12, large nut 13, and the rear of return mechanism 3.

Of moving assembly 102, parts are all connected to sliding member 2 and move together as one piece. Moving assembly 102 is able to move because of wheel and bearing assemblies 5 at the front and rear of sliding member 2. A tire 23 can roll forward on the top of base member 1 until side bearings 7 contacts end flare 26 of base member's 1 top layer.

Elastomer 3 elongates while held about a rear bolt 14, which remains stationary. For this embodiment, elastomer 3 is essentially a bunji which stretches. Return mechanism 3 is connected to moving assembly 102 about top spacer 17 and under top washer 9 and large washer 12. Return mechanism 3 is then connected to stationary assembly 101 about rear bolt 14. Return mechanism 3 provides resistance so that moving assembly 102 does not hit end flare 26 violently, whereas with some practice users will be able to prevent moving assembly 102 from striking end flare 26.

Ski assembly 100 when operated moves from its start position in FIG. 1 to its end position in FIG. 2 and then returns to the start position. Ski assembly 100 returns to the start position because of return mechanism 3. When moving assembly 102 is pushed forward by a user, return mechanism 3 yields to the force. When ski assembly 100 is lifted up such as a ski is lifted up while skiing, the forward force is released, return mechanism 3 draws stationary assembly 101 forward, returning ski assembly 100 to the start position.

Ideally, a user would have a ski assembly 100 on each of their feet. Although there are exercises and drills which utilize only one ski assembly 100, the main purpose is to simulate skiing with a ski on each foot. This is done by the user repeating the start to end position process FIGS. 8, 9—Operation of Alternative Embodiment This embodiment of the operation is similar to that of FIG. 2. In FIG. 8 we have an addition assembly 103 in the start position. In FIG. 9 the ski has been moved to the end position.

Additional assembly 103 travels to the end position beginning with sliding member 2 moving across alternate member 1A. Sliding member 2 pushes flexible connector 31 forward which pushes rolling tip 30 and rolling bases 29 ahead and onto the ground. Sliding member 2 continues to move forward until it has reached the end of base at rolling tip 30. Once sliding member 2 is at rolling tip 30 all rolling bases 29 will be on the ground, flexible connector 31 will have flexed and additional assembly 103 will be in the end position as seen in FIG. 9.

A method for skiing simulating a diagonal stride technique, includes securing each of the user's feet to an all-terrain ski through means of a binding or foot strap. The user steps straight forward with the one all-terrain ski, pushing said top member forward across said base member and shifting one's weight onto said ski. The user then picks up the second ski, stepping forward and in front of the other ski, pushing forward and sliding the top member of said ski across said ski's base member. As the user's weight is shifted onto the second ski, the first ski is lifted and one's weight is taken off of said ski, allowing the ski to pull the base member forward allowing said top member to later slide across said base member again. Repeating this process simulates the diagonal striding technique.

A method for skiing simulating a skating technique, includes securing each of the user's feet to an all-terrain ski through means of a binding or foot strap. The user steps one ski diagonally outward pointing the ski in the same direction. The user then pushes his/her weight onto said ski, sliding said top member across said base member. The user then picks up the back ski and pulls it in towards the first ski. The user steps out with the second ski perpendicular to the first ski, shifting his/her weight onto it while sliding said top member across said base member. The user then picks up the first ski, allowing said base member to slide back into its original place, then pulling it towards the second ski. Repeating this process simulates the skating technique.

CONCLUSION, RAMIFICATIONS, AND SCOPE

Accordingly, the reader will see that this all-terrain ski provides users with a safe, easy-to-use, and economical device for simulating cross-country skiing while teaching and reinforcing proper technique. Furthermore, the all-terrain ski has additional advantages in that

- it is not limited to any ability level;
- it requires less balance than most skiing simulators;
- there is no road vibration like with similar rolling devices;
- it can stop easily and does not need any braking mechanism;
- it is designed to maintain a safe and reasonably-low speed at all times;
- it may be used on virtually any surface;
- it has a low center of gravity which helps the stability on the ski;
- it is relatively small and lightweight compared to exercise machines;
- it is not limited to any single technique;
- it gives users an excellent cardiovascular and strength workout;
- it may be used indoors and outdoors;
- it may be used on a very wide variety of terrains including grass, gravel, sand, roads, and dirt trails;
- it has adjustable levels of resistance for varying difficulty of workouts;
- it has adjustable ratchet bearings which provide different types of workouts.

While the above description contains many specificities, these should not be construed as limitations on the scope of the invention, but rather as exemplifications of preferred embodiments thereof. Some examples are the number of wheels, materials used, the shape of the base member, a type of extendible tip, the shape of a sliding member, types of return mechanisms, bindings, type or shape of gripping pads and placement of parts. Accordingly, the scope of the invention should be determined not by the embodiments illustrated, but by the appended claims and their legal equivalents.

I claim:

1. An all-terrain ski, comprising (a) a base member, (b) a top member aligned with and connected to said base member, said top member movable over said base member from a first position to a second position, (c) a return mechanism connecting said base member to said top member, allowing said top member to return to said first position on said base member, and (d) a shock absorber attached to said base member with means for absorbing force created by said return mechanism returning said top member to said first position, whereby said all-terrain ski simulates cross-country skiing by said top member moving directly atop said base member.

2. The all-terrain ski of claim 1, further including a plurality of bearings which support said top member atop said base member and provide means for said top member to move across said base member.

3. The all-terrain ski of claim 1, further including a plurality of wheels which support said top member over said base member and provide means for said top member to move on said base member.

4. The all-terrain ski of claim 1, further including a cross-country ski binding mounted on said top member.

5. The all-terrain ski of claim 1, further including a flexible plate applied to said top member and foot straps joined to said flexible plate.

6. The all-terrain ski of claim 1, further including a ski boot molded into a ski binding or flexible plate with means for having a permanent boot on said all-terrain ski.

7. The all-terrain ski of claim 1 wherein said top member is movable to a plurality of positions along said base member.

8. The all-terrain ski of claim 1 wherein said return mechanism has means for urging said top member back to its starting position.

9. The all-terrain ski of claim 1 wherein said return mechanism has means for acting as a resistive force against said top member sliding forward over said base member.

10. The all-terrain ski of claim 1 wherein said return mechanism has means for being removed and replaced.

11. The all-terrain ski of claim 1 wherein said return mechanism is formed of an elastic material.

12. The all-terrain ski of claim 11 wherein said elastic material is selected from the group consisting of elastomers, latex, rubber, and urethane.

13. The all-terrain ski of claim 1 wherein said return mechanism is comprised of a spring-like mechanical device.

14. The all-terrain ski of claim 13 wherein said return mechanism is selected from a group consisting of gas springs, dampers, hydraulic dampers, extension springs, torsion springs, and air spring.

15. The all-terrain ski of claim 1 wherein said return mechanism has means for being set at a plurality of positions along said all-terrain ski.

16. The all-terrain ski of claim 1 wherein said return mechanism has means for adjusting its length.

17. The all-terrain ski of claim 1, further including a number of pads mounted on said all-terrain ski that provide means for keeping said base member stationary while on a surface.

18. The all-terrain ski of claim 17 wherein said pads have studs mounted on the bottom which contain means to increase friction against a surface.

19. The all-terrain ski of claim 18 wherein said studs are formed of a hard material.

20. The all-terrain ski of claim 19 wherein said hard material is selected from the group consisting of hardened steel, and carbide.

21. The all-terrain ski of claim 1 wherein said pads are part of said base member.

22. The all-terrain ski of claim 1 wherein said base member is composed of a wear-resistant material.

23. The all-terrain ski of claim 22 wherein said wear-resistant material is selected from a group consisting of polyethylene, polyurethane, Kevlar, graphite, and fiberglass.

24. The all-terrain ski of claim 1 wherein said base member is hollow as a means for reducing weight.

25. The all-terrain ski of claim 1 wherein said base member is solid as a means for increasing rigidity.

26. The all-terrain ski of claim 3, further including ratcheted bearings in at least one of said wheels to provide means for preventing said top member from prematurely returning to a pre-slid position.

27. The all-terrain ski of claim 26 wherein said ratchet bearings may be adjusted and likewise turned on or off.

28. The all-terrain ski of claim 27 wherein said ratchet bearings may be adjusted and likewise turned on or off by tightening or loosening said bearing at the fastener, bolt, or alike holding the bearing assembly together.

29. The all-terrain ski of claim 1, further including an extension on said base member, similar to said member, which would provide means for a longer ski base.

30. The all-terrain ski of claim 29 wherein said extension is curved and rolls into alignment with said base member.

31. The all-terrain ski of claim 29 wherein said extension slides outward from said base ski.

32. The all-terrain ski of claim 1, further including a high-friction top surface on said base member which provides means for preventing unwanted backward motion of said top member over said base member.

33. The all-terrain ski of claim 32 wherein said high-friction top surface is comprised of a high-friction material applied to the top of said base ski.

34. The all-terrain ski of claim 33 wherein said high-friction material is sprayed onto said base member.

35. The all-terrain ski of claim 34 wherein said high-friction material is rubbed onto said base member.

36. The all-terrain ski of claim 31 wherein said high-friction top surface is part of said base ski.

37. The all-terrain ski of claim 29 wherein said high-friction top surface is said base ski's top surface altered such that is it rough in texture.

38. The all-terrain ski of claim 29 wherein said high-friction top surface is comprised of an abrasive surface.

39. The all-terrain ski of claim 35 wherein said abrasive surface is selected from a group consisting of rubber, stanoprene, and sand paper.

40. The all-terrain ski of claim 1, further including an end flare on the front, top end of said base member that provides means for preventing said top member from sliding off the front of said base member.

41. The all-terrain ski of claim 1, further including side bearings, connected to said top member and aligned with the side of said base member, which provide means for keeping said top member aligned with said base member.

42. The all-terrain ski of claim 1, further including a return mechanism holder which provides mean for adjusting said return mechanism.

43. A method for skiing simulating a diagonal stride technique, comprising (a) securing each of the user's feet to an all-terrain ski through means of a binding or foot strap, (b) the user stepping straight forward with the one all-terrain ski, pushing said top member forward across said base member and shifting user's weight onto said ski, (c) the user picking up the second ski and stepping forward and in front of the other ski, pushing forward and sliding the top member of said ski across said ski's base member, and (d) as user's weight is shifted onto the second ski, the first ski is lifted and user's weight is taken off of said ski, allowing the ski to pull the base member forward allowing said top member to later slide across said base member again, whereby repeating this process simulates the diagonal striding technique.

44. A method for skiing simulating a skating technique, comprising (a) securing each of the user's feet to an all-terrain ski through means of a binding or foot strap, (b) the user stepping one ski diagonally outward pointing the ski in the same direction, (c) pushing the user's weight onto said ski, sliding said top member across said base member, (d) the user picking up back ski and pulling it in towards the first ski, (e) the user stepping out with the second ski perpendicular to the first ski, shifting the user's weight onto it while sliding said top member across said base member, and (f) the user picking up first ski, allowing said base member to slide back into its original place, then pulling it towards the second ski, whereby repeating this process simulates the skating technique.

* * * * *